United States Patent [19]

Klygis

[11] 4,386,698

[45] Jun. 7, 1983

[54] BOTTLE MULTI-PACKAGE AND PACKAGING DEVICE

[75] Inventor: Mindaugas J. Klygis, Barrington, Ill.

[73] Assignee: Illinois Tool Works Inc., Chicago, Ill.

[21] Appl. No.: 301,079

[22] Filed: Sep. 11, 1981

[51] Int. Cl.[3] ..... B65D 65/00; B65D 75/00

[52] U.S. Cl. ..... 206/432; 206/427; 206/497

[58] Field of Search ..... 206/427, 429, 432, 434, 206/430, 431, 435, 497

[56] References Cited

U.S. PATENT DOCUMENTS

| | | | |
|---|---|---|---|
| 2,290,969 | 7/1942 | King | 206/434 |
| 3,133,387 | 5/1964 | Harrison | 206/432 |
| 3,811,243 | 5/1974 | Cunningham | 206/432 |
| 3,977,518 | 8/1976 | Arneson | 206/434 |
| 4,128,169 | 12/1978 | Arneson | 206/434 |
| 4,304,332 | 12/1981 | Danti | 206/432 |

*Primary Examiner*—Joseph Man-Fu Moy

[57] ABSTRACT

A multi-package of a group or array of bottles and a packaging device which covers and supports the array of bottles on all six sides of the array. The device includes side walls and end restraining means integrally connected to top regions and bottom supporting means. The bottom supporting means contacts at least portions of the bottoms of all the bottles in the array and the perimeter defined by a combination of the side walls and end restraining means is not substantially less than the perimeter of the array. The top region includes at least a pair of opposed, generally oblong holes that facilitate telescopic association with at least two bottles in the middle ranks of the array and permits tightening in the vertical direction in the array.

11 Claims, 15 Drawing Figures

BOTTLE MULTI-PACKAGE AND PACKAGING DEVICE

BACKGROUND OF THE INVENTION

Many devices are known in the prior art for multi-packaging of bottles. Problems in the art are typically the following; prevent bottles from skewing in the package, shield the bottles from damage and reduce chance of pressurized container bursting and spraying particles, difficulty of handling by consumer, difficulty of assembling of the packaging device to the array, producing the packages at a cost that will render them economical, provide sufficient advertising, etc. Many of the prior art suggestions in one way or another solve one of more of the above problems. For example, paperboard baskets and wraps are effective in some areas of packaging. A heat shrink film technique has been used in an attempt to solve the economic problems. Highly stretched tubes or films are used, however, this technique involves some sophisticated problems in application and appearance of the resulting package, top gripping clips have been utilized but generally the integrity and stability of such a package and ease of handling is not acceptable.

Examples of some prior techniques are shown in U.S. Pat. No. 3,837,478 which is directed to the highly stretched packaging device and U.S. Pat. No. 4,066,166 which is directed to a bag-like, semistretched device involving a bundling or typing of a truss elements in the top region.

SUMMARY OF THE INVENTION

The package of this invention involves bottles or containers arranged in an array usually including two, adjacent, rows and a plurality of ranks arranged to extend in directions generally perpendicular to the direction of the rows. The bottles considered to be packed by this invention are most typically defined as including a capped upper end of a substantially smaller diameter than a main body portion. The bottles have various neck shapes diverging downwardly from the capped upper end to the main body and often defining a shoulder section. Oftentimes these bottles are made of glass but more recently such bottles are made of a relatively thermoplastic, P.E.T. material. It is the latter type of bottles that this package is uniquely adapted to accomodate.

As will be shown later herein, the packaging device generally described by this invention is adaptable to handle a wide variety of arrays of such bottles 2, 4, 6, 8, etc. The physical characteristics and construction of the device makes it highly adaptable and utilizeable on the various types of arrays that are often required by packagers and consumers.

It is a primary object of the invention to provide a one-piece, resilient package for bottles that is easily handled.

A further object of the invention is to provide a packaging device that is relatively easy to assemble to a wide variety of arrays of bottles and which is capable of being printed to carry a relatively large descriptive or advertising message on the package.

Several important features of the invention will become apparent in the following detailed description and will be summarized herein.

The peripheral dimension defined by the combination of the side walls and end restraining means of the packaging device should be substantially equal, and preferably not substantially greater or less than the perimeter of the dimension defined by the array to be packaged. This will permit relatively easy association of the packaging device with the array using automated equipment because the package making device does not have to be stretched. The stretching of the package has some disadvantages because of the requirement for high force applicating equipment and the necessity for sophisticated printing and/or material specifications.

The top region of the device is integral to the top margins of the side panels of the device and includes a pair of oblong or elongated apertures which are centrally located both relative to the transverse and longitudinal centerline of the package. The length dimension of the oblong holes lies along the centerline of the device. The oblong holes serve two purposes; first, they permit easy association with a pair of bottles in the centermost rank of the array. The minimum dimension of the oblong apertures creates a flexible, resilient, mechanical lock on the necks of the bottles beneath the caps to provide a stable package. Furthermore, the lengthwise dimension of the holes permits some flexibility in the vertical peripheral direction when the package is tightened by pulling and sealing the bottom of the device.

The combination effect of the nonstretching structure, the complete envelopment of the total array and isolation at least a limited number of the bottles in at least in the neck regions obviously permits this packaging device to be used as a return vehicle for the used bottles.

Other objects and features of the invention will be apparent upon perusal of the hereinafter following detailed description read in conjunction with the drawings.

DETAILED DESCRIPTION OF THE DRAWINGS

DETAILED DESCRIPTION OF THE PREFERRED EMBODIMENTS

Figure 1:
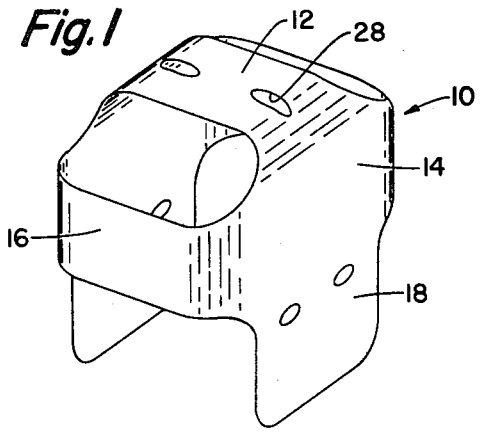
FIG. 1 is a perspective view of a packaging device in accordance with the invention, in an open condition ready to be associated over an array of bottles to be packaged.
Figure 4:
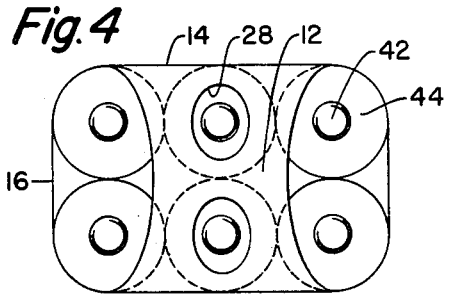
FIG. 4 is a top plan view of a package created utilizing the packaging device of FIG. 1.
Figure 3:
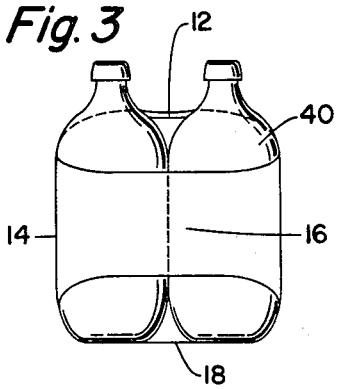
FIG. 3 is an end elevational view of a package created utilizing the packaging device of FIG. 1.
Figure 2:
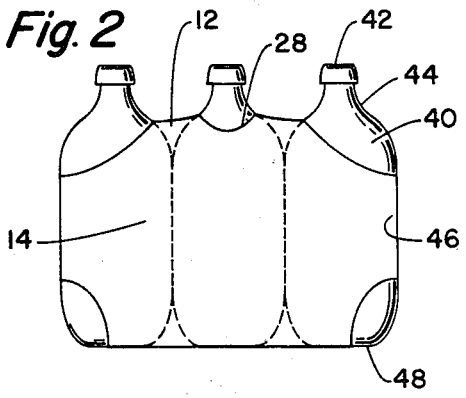
FIG. 2 is a side elevational view of a package created with the packaging device of FIG. 1.

FIGS. 1 through 4 show a group or array of bottles 40. The bottles may generally be described as having a shape including a top 42, a gradually enlarged shoulder region 44, a generally cylindrical body section 46 and bottoms of bases 48. The bottles may, of course, either be glass or plastic; however, the advantages of the packaging device of this invention are particularly utilized with a plastic bottle. The packaging device 10 substantially envelops the array, contacting and supporting all six sides of the array with top wall 12, side walls 14, end restraining wall or band 16 and bottom wall 18. The bottom wall advantageously contacts at least portions of the bottoms of all bottles.

Figure 5:
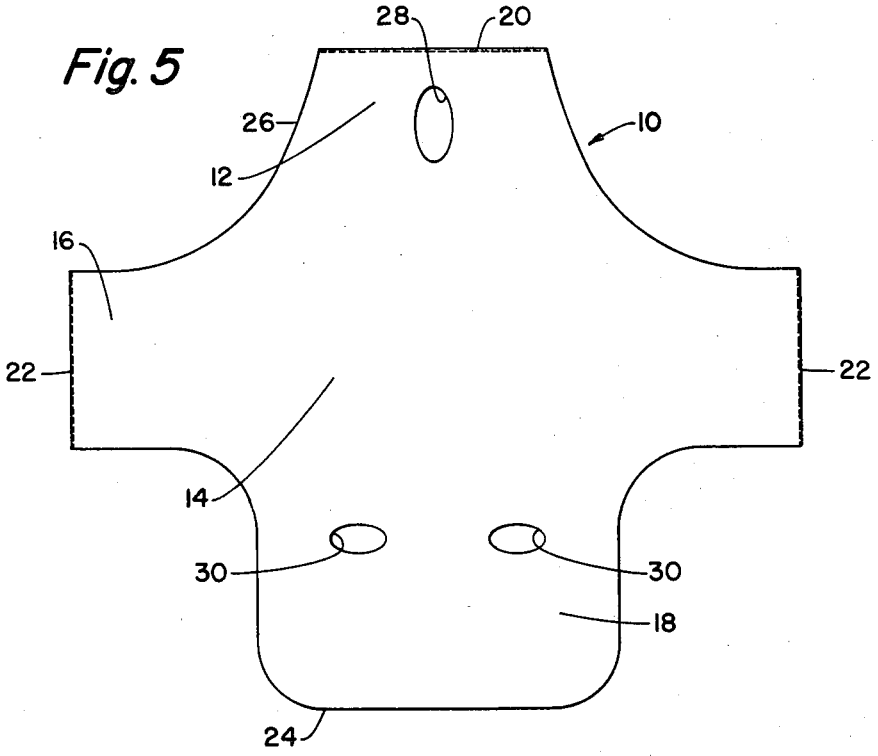
FIG. 5 is a plan view of the flattened package device of FIG. 1.

The device 10 shown most clearly in FIGS. 1 and 5 is preferably made of a thin, flexible material such as low density polyethylene. It is configured to be constructed by a pair of overlying, juxtaposed layers of such film as shown by the blank or pattern of FIG. 5. The device 10 may be configured to be interconnected in reel form by perforations adjacent top and bottom margins or alternatively side margins. The device shown in FIGS. 1 and 5 is basically a flattened pair of films of identical patterns with side marginal edges 22 being connected either by the manufacture of the device as a tube or by heat sealing and the top marginal edge of the device 20 likewise being connected. It should be noted that the bottom region 18 has marginal edges 24 that are not connected permitting the juxtaposed films at the bottom region of the blank to move relative to one another. Likewise, the margin or region 26 between the upper margin 20 and the side margin 22 is unconnected. As will be shown in FIG. 1, the flattened device of FIG. 5 may be opened by suitable mechanisms to the configurations shown in FIG. 1. This opened device is moved relative to the array to be packaged in the direction of the arrows and creates the package shown clearly in FIGS. 2 through 4.

Particular attention is directed to the apertures 28 of the device and their resulting association with the necks of the bottles in the innermost rank of the array. The configuration of the elongated aperture 28 in the vertical transverse direction permits the necks of the two bottles in the innermost rank to be relatively freely telescoped within these apertures and still permits the device to be tightened in the vertical peripherial direction by pulling the bottom regions 18 together beneath the package and heat sealing or otherwise connecting it. It is this tensioning that finalizes the support and securement of the package. The isolation of at least the top regions of the innermost rank of bottles from one another thus prevents the skewing or relative movement of the bottles from their originally described rank and row positions. The perimeter of the device defined by the end restraining region 16 and side wall regions 14 is preferably substantially equal to the perimeter defined around the array of bottles. With such a dimension and in combination with the rank restraining apertures 28, the package is suitably secured from skewing. The combination of the bottom panel 18, the frictional engagement of the side walls 14 with the body sections 46 of the bottle, and the engagement of the minimum dimension of the apertures 28 with the bottle necks creates a package which can be reliably handled. Notches 30 in the bottom regions 18 permits positive engagement of the stable device in packaging machinery.

Hereinafter, like reference numerals throughout the various views of the drawings are intended to designate similar elements and components.

Another variation of the basic premise of the invention is shown in FIGS. 6 through 10. The blank or pattern device shown in FIG. 6 again generally describes a device 10*a* having top region 12*a*, side wall region 14*a* and end restraining means 16*a* and a bottom supporting region 18*a*. The top margin 20*a* includes notches 32 on either side of the vertical centerline of the blank which creates outer margin segments 21 of the top margin 20*a*. It is these outer segments and the associated and resulting D-shaped hole formed from the notches 32 that are shown as being particularly advantageous in the package of FIGS. 7 through 10.

Figure 8:
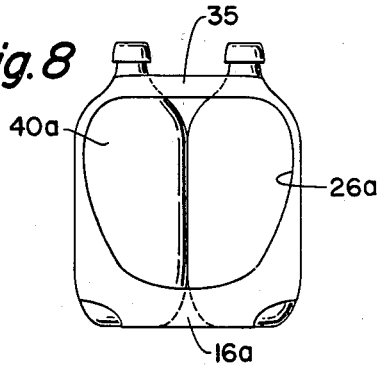
FIG. 8 is an end elevational view of a package created utilizing the packaging device of FIG. 6.
Figure 9:
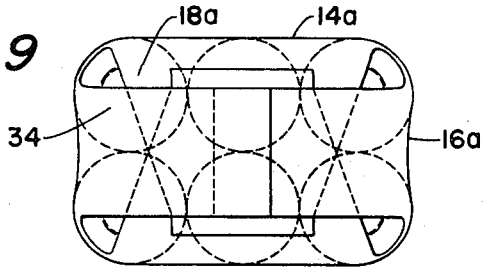
FIG. 9 is a bottom plan view of a package created utilizing the packaging device of FIG. 6.

The D-shaped aperture 32 is positioned so that a rather large radiused curvalinear edge 33 is formed as an innermost edge which serves as a handle gripping means. The large radius is important as it tends to reduce the concentration of forces tending to tear or fracture the thin film when lifting. Furthermore, the D-shaped aperture and resulting confining bands 35 serve to further restrain the bottles within the package. The bands 35 permit a reduction in material in the end portions of the package by serving as, in part, an end restraining means as well as top confining means. The bottom region of the package creates the primary and restraining means 16*a* and it is provided structure and support by additonal bottom flaps 34 which depend from the end restraining region. These bottom flaps will be seen in FIG. 8 are joined with the primary flaps 18*a*. The resulting hole regions 36 further serve to locate the bottles by partial insertion of the bottoms of the bottles within this aperture.

Figure 6:
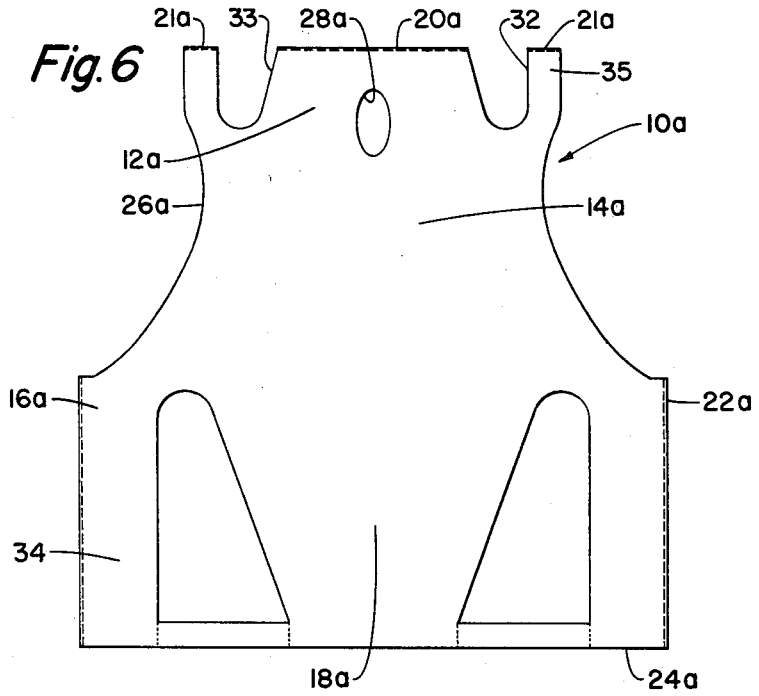
FIG. 6 is a plan view of an alternate embodiment of a packaging device in accordance with the invention.

A further advantage of the design of the device shown in FIG. 6 is the necking in or reducing of the width of the side margins 26*a* of the device 10*a*. With this necking-in of the pattern, the unsecured edges of the margin 26*a* are not permitted to extend beyond the curvature of the bottle, as shown in the side elevational view of FIG. 7. These edges 26*a* in fact conform to the contour of the bottles within the length dimension shown in FIG. 8 and the association of the shoulder with these margins again contribute to the stability of the package.

Figure 10:
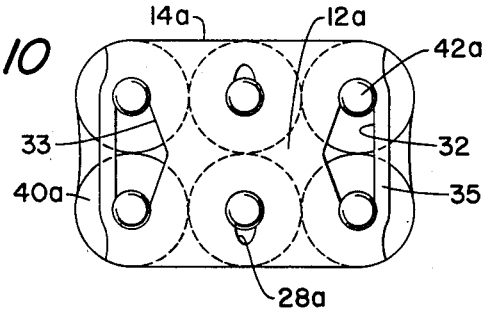
FIG. 10 is a top plan view of a package created utilizing the packaging device of FIG. 6.
Figure 7:
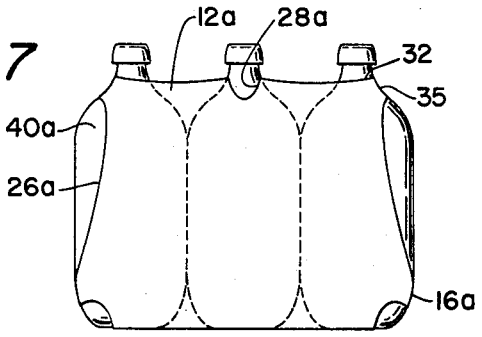
FIG. 7 is a side elevational view of a package created by the packaging device of FIG. 6.
Figure 11:
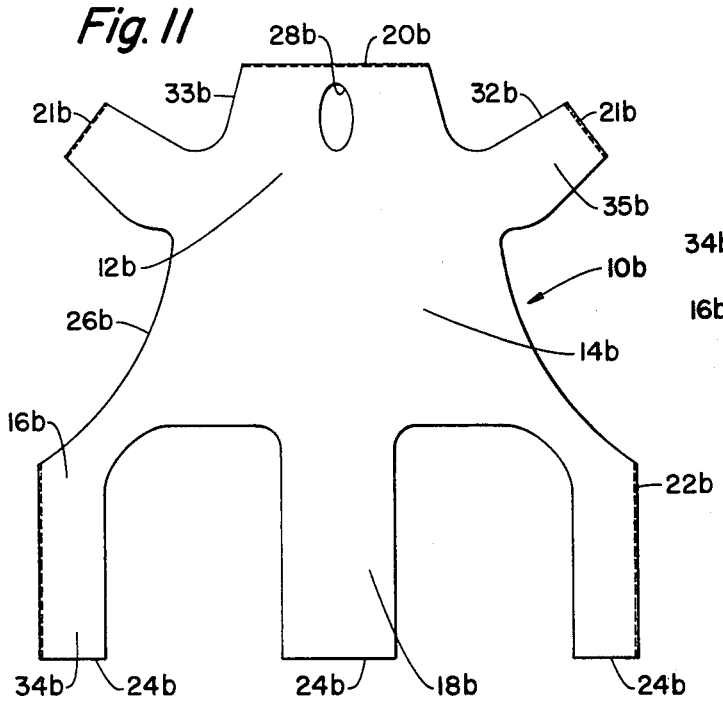
FIG. 11 is a plan view of another alternative version, a flattened packaging device in accordance with this invention.
Figure 12:
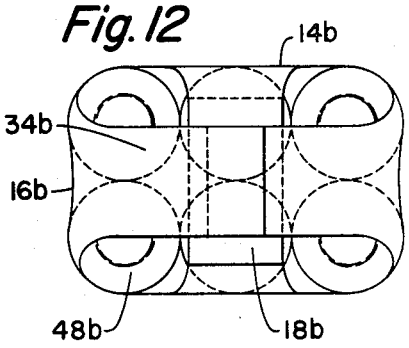
FIG. 12 is a bottom elevational view of a package created by the device shown in FIG. 11.

A slightly different version of the device and package described in FIGS. 6 and 10 is shown in FIGS. 11 and 12. In device 10*b*, the top marginal outer segments 21*b* are shown to extend at an acute angle to the remainder of the top margin 20*b*. The resulting notch 32*b* creates the D-shaped aperture similar to that shown in FIG. 10. However, the positioning of the band segment 35*b* at an acute angle to the top margin 20*b* permits the width of each flap to be increased to insure that that surface is snuggly supporting the associated shoulder portions of the bottle without the outer edge of the band tending to disassociate from the shoulder of the bottom.

The bottom panel 18*b* is shown to be slightly different due to the rectangular bottommost regions of the blank. However, in keeping with a basic premise of the invention, the bottom panel 18*b* contacts at least portions of the bases of each bottle in the array.

Figure 13:
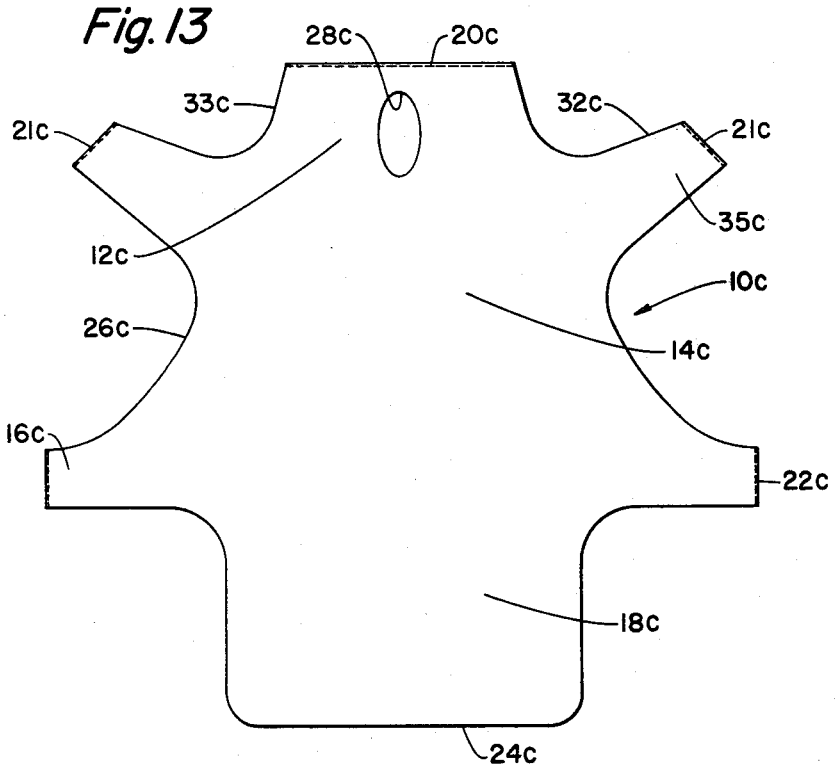
FIG. 13 is a plan view of a packaging device showing yet another alternative version of the invention.

The device 10*c* shown in FIG. 13 illustrates a further slightly different alternative of the device shown in FIGS. 6 through 12 utilizing a single pair of flaps 18*c* in a manner similar to that shown in FIGS. 1 through 5.

Figure 14:
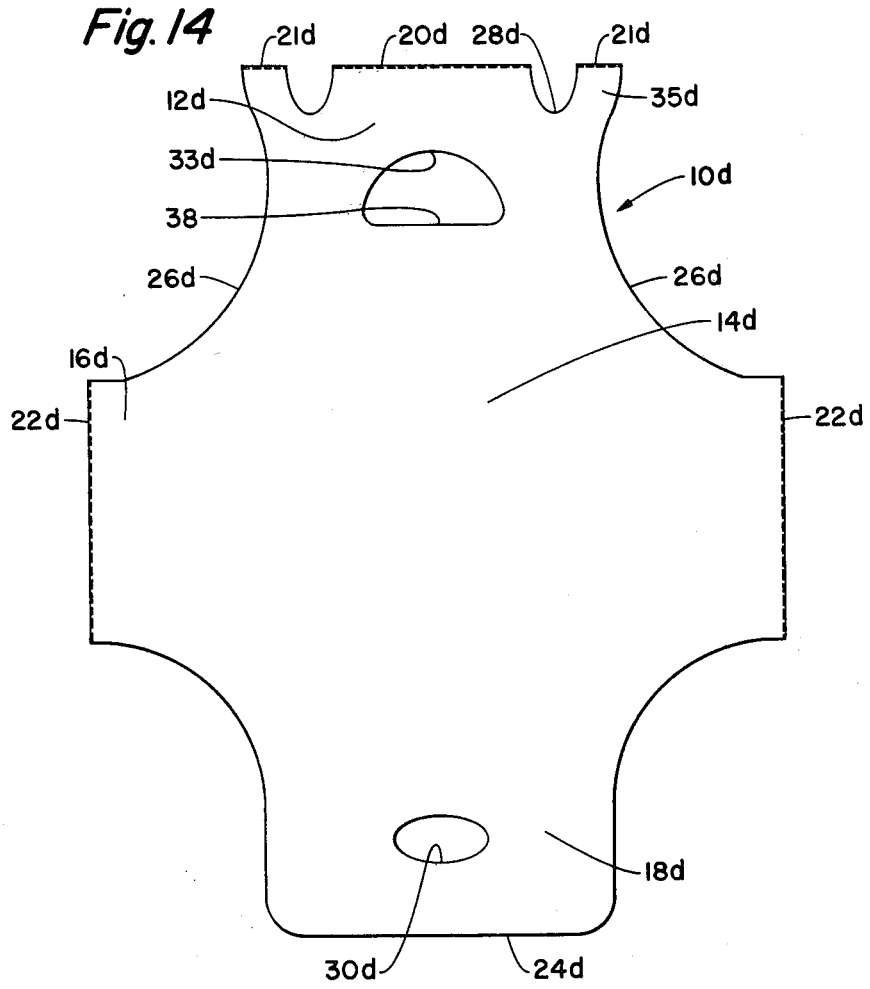
FIG. 14 is a plan view of an alternative version of the invention for an array of two bottles.
Figure 15:
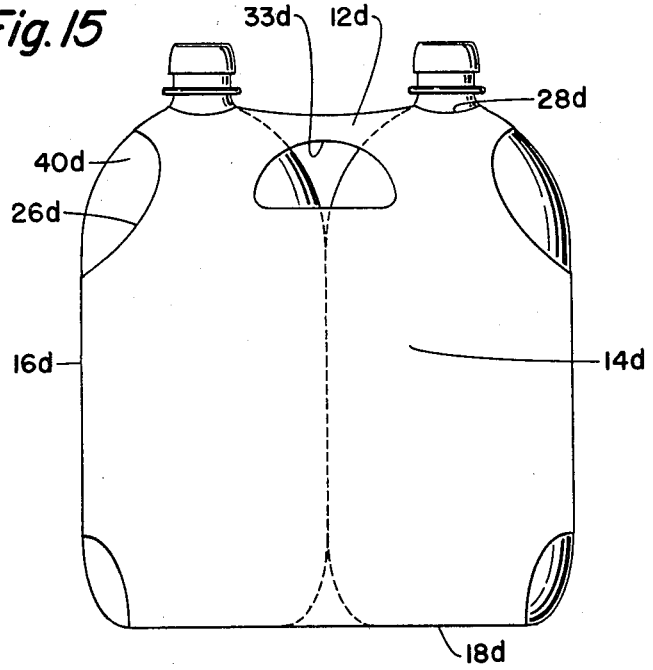
FIG. 15 is a side elevational view of a package created by the device of FIG. 14 for a two bottle array.

As indicated above, the basic structures and configurations of the device permits it to be readily adaptable for any variety of arrays of bottles. With this in mind, FIGS. 14 and 15 show a device 10*d* and a package created thereby in accordance with this invention for an array of two bottles 40*d*. The package primarily will be the larger two liter bottles of plastic material, and as shown from the blank in FIG. 14 it includes the basic structures of all the devices mentioned hereinabove. Device 10*d* includes a top margin 20*d*, side margins 22*d* and top margin segments 21*d*. The top margins are interrupted by notches 32*d* which are slightly elongated in the vertical direction of the strip much like the notches 28 in the embodiment showing a package for six or more bottles. These notches 32*d* serve the same function as the notches 28 and isolate the two bottles from each other. An enlarged handle gripping notch 38 is formed adjacent the top margin of the device 10*d* and it serves adequate and effective function in that it also includes the curvalinear edge 33*d*. The unattached margins 26 are shown to be necked-in in accordance with the discussion above for the same purpose as noted above.

Having described the invention, it is to be understood that other changes can be made in the described embodiment by one skilled in the art within the spirit and scope of the invention as described in these claims.

I claim:

1. In a package for a plurality of bottles arranged in a predetermined array of ramps and rows of bottles in upstanding, side-by-side, generally abutting relationship, the array in the composite defining a bottom, a top, two sides in the row direction and two ends in the rank direction, a package device of thin, flexible, thermoplastic material nonstretchingly associated about the array, the device including a pair of opposing side walls, a pair of opposing end confining means, a top region extending integrally between the top margins of the side walls and a bottom region extending continuously across the bottom of the array and supportingly contacting at least portions of the bottoms of each of the containers in the array, the top region extending across the package at an elevation below the uppermost extremities of the array and supportingly engaging the necks of the bottles in the array, the top region including a pair of opposing, oblong aperture means for receiving and isolating the neck regions of two opposing bottles in the array, the perimeter of the device generally equal to the perimeter of the array.

2. The package of claim 1 wherein the bottom portion of the device comprises two flaps heat sealed together to create an integral support for said package.

3. The package of claim 1 wherein the array is six bottles in two rows and three ranks, the two opposing bottles in the second rank being isolated and supported at their tops by the oblong apertures, the outer members being supported at their top by the side margins of the top regions, the top regions being tight enough to provide surface conforming contact with shoulders of the bottle in all ranks.

4. The package of claim 1 wherein the side walls and end confining means of the device are continuous panels of thermoplastic material having an axial height substantially equal to the height of the body portion of the bottles.

5. The package of claim 1 wherein the top regions include a pair of elongated, generally D-shaped apertures, the D-shaped apertures extending in the rank direction, located on both sides of the pair of oblong aperture means, the D-shaped aperture registering with pairs of bottles in ranks on either side of the central rank.

6. The package of claim 5 wherein the outer margins of the top region create a pair of array conforming bands supporting the shoulders of the outermost ranks of bottles and in cooperation with a lower band means create axially spaced end confining means.

7. A packaging making device for securing and confining a predetermined array of bottles which include a base, side wall body section, shoulder, neck and cap region, the device being constructed of a pair of layers of identically configured thin thermoplastic material juxtaposed relative to one another creating a flattened pattern, the pattern having a top region and a pair of opposing side margins which integrally join the pair of layers and a lower margin in which the layers are unconnected to permit said lower margins to be opened for nonstretching, telescopic association over on the array of bottles, an aperture means formed through the juxtaposed layers adjacent the lower margin to facilitate handling of the lower regions of each layer and securing them together to create a supporting base for the array of bottles in the finished package.

8. The package making device for two bottles of claim 7 wherein the upper margin is notched in two spaced regions creating oblong apertures in a top region of the device to receive the necks of the two bottles, the upper margin having a predetermined width which is less than the width dimension between opposing side margins, the pattern being necked in between the upper margin and side margin, the necked-in region being a region where the two layers are unconnected.

9. A package making device for supporting and confining a predetermined array which include a base, side wall body section, shoulder, neck and cap region, the device being constructed of a pair of layers of identically configured thin thermoplastic material juxtaposed relative to one another creating a flattened pattern, the pattern having a top region and a pair of opposing side margins which integrally join the pair of layers and a lower margin in which the layers are unconnected to permit said lower margins to be opened for nonstretching, telescopic association over the array of bottles, an oblong aperture means formed through the juxtaposed layer adjacent the upper margin and intermediate its extremities to facilitate telescopic association over an inside rank of bottles in the array, the length dimension of the aperture being generally perpendicular to the upper margin.

10. The package making device of claim 9 wherein the upper margin is also notched in two spaced regions to receive the necks of a pair of bottles each in ranks on either side of said inside rank.

11. The package making device of claim 10 wherein the upper margin having a total width which is less than the width dimension between opposing side margins, the pattern being necked-in between the upper margin and side margin, the necked-in region being a region where the two layers are unconnected.

* * * * *